US006709798B2

(12) United States Patent
Tamaoki et al.

(10) Patent No.: US 6,709,798 B2
(45) Date of Patent: Mar. 23, 2004

(54) FULL COLOR IMAGE FORMING METHOD

(75) Inventors: Junichi Tamaoki, Sakai (JP); Masayuki Hagi, Mino (JP); Masahiro Anno, Sakai (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/971,608

(22) Filed: Oct. 9, 2001

(65) Prior Publication Data

US 2002/0076630 A1 Jun. 20, 2002

(30) Foreign Application Priority Data

Oct. 25, 2000 (JP) ..... 2000-325425

(51) Int. Cl.[7] ..... G30G 13/01

(52) U.S. Cl. ..... 430/45; 430/47; 430/107.1; 430/108.1

(58) Field of Search ..... 430/45, 47, 107.1, 430/108.8, 108.1, 110.1, 110.2

(56) References Cited

U.S. PATENT DOCUMENTS 5,614,347 A 3/1997 Aoki et al.
5,738,962 A 4/1998 Ichimura et al.
5,958,642 A 9/1999 Takagi et al.
5,972,547 A 10/1999 Yaguchi et al.
6,096,463 A 8/2000 Hamano et al.
6,171,747 B1 * 1/2001 Sugizaki et al. ..... 430/45
6,187,489 B1 * 2/2001 Oishi et al. ..... 430/45
6,436,599 B1 * 8/2002 Matsuoka et al. ..... 430/137.19
6,475,690 B2 * 11/2002 Anno et al. ..... 430/108.8

FOREIGN PATENT DOCUMENTS

JP 2000-267357 * 9/2000

* cited by examiner

*Primary Examiner*—Janis L. Dote
(74) *Attorney, Agent, or Firm*—Burns, Doane, Swecker & Mathis, LLP

(57) ABSTRACT

The present invention relates to a full color image forming method for forming a full color image on a recording medium by using specific magenta toner, specific cyan toner, specific yellow toner and black toner, wherein a maximum adhering amount of the magenta toner, the cyan toner and the yellow toner on the recording medium is respectively 5.0 $g/m^2$ or less.

23 Claims, No Drawings

FULL COLOR IMAGE FORMING METHOD

RELATED APPLICATIONS

The present invention is based on Japanese Patent Application No. 2000-325425, the content of which is incorporated by reference.

BACKGROUND OF THE INVENTION

1. Field of the Invention

The present invention relates to a full color image forming method.

2. Description of the Related Art

Full color image forming methods generally include a process of forming a latent image on an electrostatic latent image-bearing member (photosensitive member) and developing this latent image with toner (developing process), a process of transferring the toner image formed on the electrostatic latent image-bearing member onto a recording medium through an intermediate transfer or without an intermediate transfer (transfer process), and a process of fixing the toner image on the recording medium (fixing process). Specifically, after each color is developed using toner of four colors of magenta, yellow, cyan, and black and the toner layers are overlaid on the recording medium, the toner layer is fixed by application of pressure and heat. The toner used in such an image forming method generally is produced by fusing, kneading, and cooling at least binder resin and colorant, which is thereafter coarsely pulverized, then finely pulverized to obtain a desired classification.

In recent years, there has been demand for better image quality, faster image forming speed and lower cost in the field of this type of image forming method, and there have been various experiments with the image forming process and toner used.

For example, it is known that a smaller average particle size of a toner is effective in attaining high image quality. However, since the specific surface area of the toner increases as the toner particles become smaller, there is a tendency for the toner charge per unit weight to increase. When the charge amount becomes excessively large, a disadvantage arises inasmuch as a desired image density cannot be attained due to limitations of development. In order to prevent reduction in image density, U.S. Pat. No. 5,738,962 describes regulating the volume-average particle size of toner, colorant content, and the weight of the solid part of the toner on a copy sheet. According to this regulation, a desired image density can be assured even at a small size particle toner by increasing the colorant content. However, when the colorant content is increased, the toner chargeability increases markedly due to the chargeability of the colorant, such that developing condition for each toner, and particularly the maximum amount of adhered toner on the recording medium, must be relatively greatly changed. When there is excessive difference in the maximum amount of adhered toner on the recording medium for each toner, it is difficult to set CD conditions for each toner during developing, and high-speed full color image formation and low cost cannot be attained. Furthermore, it is necessary to adjust the charge amount by materials other than the colorant in each toner during toner manufacture.

A relatively long time is required for the fine pulverization process in the manufacturing process of pulverized toner, thereby reducing production and making it difficult to attain low cost. U.S. Pat. No. 5,972,547 discloses art for improving the characteristics of pulverization of the toner components before kneading the toner components including a specific petroleum-based resin. In this instance the resin used as a binder resin is a resin having a glass transition point of 60° C. or higher in order to assure the storage stability of the toner. However, the toner used in this art requires a relatively long time to be fixed, and high-speed full color image formation cannot be attained.

In order to attain high-speed image formation, it has been proposed to increase the colorant content of the toner, reduce the amount of toner that adheres to the recording medium, and reduce the fusion starting temperature of the toner binder resin. However, when the amount of adhered toner is reduced, the graininess of the obtained image is exacerbated due to the reduction in the number of structural toner particles per pixel. That is, an image having coarse texture is obtained. Furthermore, when a binder having a relatively low fusion starting temperature is used, the problem of toner flocculation readily occurs. That is, the toner starts to flocculate when stored at a relatively high temperature, or flocculation starts when the toner is mixed in the developing device.

OBJECT AND SUMMARY

An object of the present invention is to provide a full color image forming method capable of providing high-quality full-color image inexpensively at high speed.

Another object of the present invention is to provide a full color image forming method capable of providing high-quality full-color image inexpensively at high speed without changing the maximum amount of toner adhering to a recording sheet for each toner.

The present invention relates to a full color image forming method for forming a full color image on a recording medium by using magenta toner, cyan toner, yellow toner and black toner, wherein a maximum adhering amount of the magenta toner, the cyan toner and the yellow toner on the recording medium is respectively 5.0 g/m$^2$ or less; the magenta toner having a volume-average particle size of 3–7.5 $\mu$m, and comprising a magenta colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin; the cyan toner having a volume-average particle size of 3–7.5 $\mu$m, and comprising a cyan colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin; the yellow toner having a volume-average particle size of 3–7.5 $\mu$m, and comprising a yellow colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin; and the black toner having a volume-average particle size of 3–7.5 $\mu$m.

DESCRIPTION OF THE PREFERRED EMBODIMENTS

The developer used in the method of the present invention may be a two-component developer obtained by in mixing toner and carrier, or may be a monocomponent developer using toner alone. In the present invention, magenta developer including magenta toner, cyan developer including cyan toner, yellow developer including yellow toner, and black developer including black toner are used as developers, however, the present invention is not limited to this arrangement inasmuch as developers of other colors also may be used in combination insofar as a full color image can be formed.

Although the description below refers to toner, the description below pertains to magenta toner, cyan toner, yellow toner, and black toner independently unless otherwise mentioned.

The toner used in the present invention includes at least a binder resin, a specific polymer (B), and colorant. Since the specific polymer (B) described later is used, in the present invention, the toner has a structure wherein the specific polymer (B) is exposed on the surface of the toner particles. Since the toner has this structure, the probability is remarkably low that the colorant will be exposed on the surface of the toner particles even when a relatively large amount of colorant is loaded, and it is believed that the difference in charge levels among the various toners is reduced based on the difference in chargeability of the individual toners. Furthermore, since the toner has the previously described structure, it effectively makes it difficult for toner flocculation to start. In addition, the toner production characteristics are effectively improved by using the aforesaid polymer (B).

When the polymer (B) is used in the manufacture of the toner, the polymer (B) is dispersed as particles in the binder resin in the kneading process, and since the kneaded material is coarsely pulverized so as to form a powder binding the dispersed particles of the polymer (B) in the pulverization process, a toner is obtained which has the polymer (B) exposed on the toner particle surface. Specifically, the presence of the polymer (B) particles in the kneaded material, it is believed that pulverization occurs through the interior of the polymer (B) not the contact surface (interface) of the binder resin and the polymer (B) particles, such that the pulverization surface if formed by the polymer (B), with the result that the polymer (B) is exposed on the particle surface.

The polymer (B) used in the present invention has a weight-average molecular weight (Mw) of 1000–3000, and desirably 1000–2800, and has a weight-average molecular weight/number-average molecular weight ratio (Mw/Mn) of 2.0 or less, and desirably 1.9 or less. When this polymer (B) is not used, a toner having the polymer (B) exposed on the particle surface is not obtained, the difference in the level of chargability among the toners of various colors becomes relatively large, the maximum amount of each toner adhered becomes relatively large and must be changed, and it becomes difficult to set the conditions for developing each toner. Furthermore, when the weight-average molecular weight (Mw) of the polymer (B) is less than 1000, the glass transition temperature of the polymer (B) is reduced, so as to adversely affect the storage characteristics (heat-resistance storage characteristics) when the toner is stored at relatively high temperature, and make it difficult to use. On the other hand, when the weight-average molecular weight (Mw) exceeds 3000, the pulverization characteristics of the material itself is adversely affected, such that the improved pulverization characteristics attained by using this material are not obtained.

In the specifications, the Mw and Mn of the polymer and resin are values measured using gel permeation chromatography (model 807-IT; Jasco Corp.). Specifically, tetrahydrofuran flows as a carrier at a rate of 10 kg/cm$^3$ through a the column maintained at 40° C., and a measurement specimen of 30 mg is dissolved in 20 ml tetrahydrofuran, and 0.5 mg of this solution is dissolved in the carrier medium and introduced to the column and Mw m and Mn are calculated by polystyrene conversion.

This polymer (B) desirably has a pulverization index of 0.1–1.0, and preferably 0.2–0.6. The pulverization index is one index expressing ease of pulverization, and the smaller the value indicates greater ease of pulverization.

In the specification, the pulverization index is a value measured as described below. When a specimen having an approximate volume-average particle size of 2 mm is pulverized at process F (5 kg/h) and KTM of 12000 (rpm) using a mechanical pulverizer (model) KTM-O; Kawasaki Heavy Industries, Ltd.) a load force value WO when the material is not processed, and a load force value W1 when the material is processed are recorded. Thereafter, the volume-average particle size D ($\mu$m) of the pulverized material obtained by KTM pulverization is measured using a COULTER Multisizer II (Beckman Coulter). The pulverization index is calculated from the obtained values based on the equation below.

$$\text{Pulverization index}=(D\times(W1-W0))/F$$

It is desirable that the glass transition point (Tg) of the polymer (B) is 50° C. or higher, and preferably 55–85° C., and ideally 60–80° C., from the perspective of improving low temperature fixing characteristics and heat-resistant storage.

In the specification, the glass transition point of the polymer and resin is the main endothermic peak shoulder value using a 10 mg specimen measured at 20–120° C. at a temperature elevation rate of 10° C./min with alumina used as a reference using a differential scanning calorimeter (DSC-200; Seiko Instruments, Inc.).

The polymer (B) is not specifically restricted insofar as the polymer (B) is not compatible even when fusion kneaded with the binder resin, i.e., has different pulverization characteristics than the binder resin, e.g., a well known aromatic monomer and/or a homopolymer or copolymer of aliphatic monomer may be used. In this instance, "different pulverization characteristics than the binder resin" means that the pulverization index of the polymer (B) is smaller, at 0.5 or more, and desirably 0.7 or more, smaller than the pulverization index of the binder resin. A toner having the polymer (B) exposed on 5 the surface can be effectively obtained by using a polymer (B) and binder resin having the aforesaid pulverization index relationship.

The aromatic monomer is represented by the general structural formula (1) below of a styrene monomer.

(1)

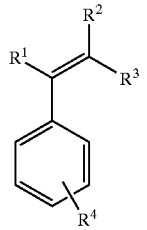

(Where R1, R2, R3, and R4 are independent hydrogen atoms, halogen atoms, or an alkyl group having 1–4 carbon atoms, e.g., methyl group, ethyl group, n-propyl group, n-butyl group, and desirably are hydrogen atoms, chlorine atoms; bromine, or methyl group.)

The aromatic monomer is further represented by the general structural formula (2) below of an indene monomer.

(2)

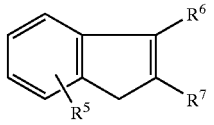

(Where R1, R2, R3, and R4 are independent hydrogen atoms, halogen atoms, or an alkyl group having 1–6 carbon atoms, e.g., methyl group, ethyl group, n-propyl group, n-butyl group, n-pentyl group, n-hexyl group, and desirably are hydrogen atoms, chlorine atoms, bromine, or methyl group.)

Specific examples of useful styrene monomers include styrene, vinyl toluene, α-methyl styrene, isopropenyl toluene, β-methylstyrene, 1-propenyltoluene, o-chlorostyrene, m-chlorostyrene, p-chlorostyrene, α-chlorostyrene, β-chlorostyrene, o-bromostyrene m-bromostyrene, p-bromostyrene, α-bromostyrene, β-bromostyrene and the like, and desirably styrene, vinyltoluene, α-methylstyrene, isopropenyltoluene, β-methylstyrene, 1-propenyltoluene, more desirably styrene, vinyltoluene, α-methylstyrene, isopropenyltoluene, and most desirably styrene, α-methylstyrene, and isopropenyltoluene.

Specific examples of useful indene monomers include indene, methylindene, ethylindene and the like, and among these, indene is particularly desirable. In this case, it is desirable that a monomer of the highest purity is used to suppress reduction of color, odor, and amount of VOC (volatile components) of the resin.

Aromatic monomers may be used individually or in combination.

Aliphatic monomers are not specifically limited insofar as they are polymerizable with the aforesaid aromatic monomers; specific examples of useful aliphatic monomers include diolefin monomers such as isoprene, piperylene, 1,3-butadiene, 1,3-pentadiene, 1,5-hexadiene, 2,3-dimethyl-1,3-butadiene, chloroprene, 2-bromo-1,3-butadiene and the like, monoolefin monomers such as ethylene, propylene, butylene, isobutylene, 2-methyl-butene-1,2-methylbutene-2 and the like, alkyl ester acrylate monomers such as methylacrylate, ethylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate, dodecylacrylate and the like, alkyl ester methacrylate monomers such as methyl methacrylate, ethyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, dodecyl methacrylate and the like, unsaturated carboxylic acid monomers such as acrylate, methacrylate, itaconic acid, maleic acid and the like, and acrylonitrile, maleate, itaconate, vinylchloride, vinylacetate, vinylbenzoate, vinylmethylethyl ketone, vinylhexyl ketone, vinylmethyl ether, vinylethyl ether and vinylisobutyl ether and the like. Monoolefin monomers and diolefin monomers are desirable, isopropenyl, piperylene, 2-methyl-butene-1,2-methylbutene-2, are more desirable, and isoprene is most desirable.

Aliphatic monomers may be used individually or in combination.

In the polymer (B) formed of the aforesaid monomers, it is desirable to selected one or more monomers from among the group of aromatic monomers of styrene, α-methylstyrene, and isopropenyltoluene in the polymer (B) formed of the aforesaid monomers, isoprene as the aliphatic monomer, and an aromatic monomer and/or homopolymer or copolymer of an aliphatic monomer.

A desirable polymer (B) is obtained by synthesis using as raw materials diolefin and/or monoolefin included in cracked petroleum products resulting as by-products of plants that manufacture ethylene, propylene and the like by petroleum-type steam cracking.

Specific examples of desirable polymer (B) include polystyrene, poly-α-methylstyrene, styrene-α-methylstyrene copolymer, α-methylstyrene-isopropanyltoluene copolymer, styrene-isopropanyltoluene copolymer, α-methylstyrene-isopropanyltoluene-isoprene copolymer, styrene-isopropanyltoluene-isoprene copolymer and the like, and polystyrene and poly-α-methylstyrene are desirable from the perspective of reducing the difference in the charge levels among the toners of various colors.

When polystyrene is used as the polymer (B), the weight-average molecular weight is desirably in the range of 1000–3000.

When poly-α-methyl styrene is used as the polymer (B), the weight-average molecular weight is desirably in the range of 2000–2800.

The amount of polymer (B) used is 1–20 parts-by-weight, and preferably 3–15 parts-by-weight relative to 100 parts-by-weight binder resin. When an insufficient amount of polymer (B) is used, it is difficult to improve the pulverization characteristics of the toner components. When an excessive amount of polymer (B) is used, the toner is easily over-pulverized, and there is a tendency of wide variation in the size of the toner particles in the developing device.

The binder resin is not specifically limited, and well known synthetic resins and natural resins in the field of toners used in electrostatic charge development may be used. For example, polystyrene resin, styrene resin, polyvinyl chloride, phenol resin, natural modified phenol resin, natural modified maleic resin, acrylic resin, methacrylic resin, polyvinyl acetate, silicone resin, polyurethane, polyamide resin, furan resin, epoxy resin, xylene resin, polyvinylbutyral, terpene resin, coumarone-indene resin and the like. It is desirable to use polyester resin, polyester resin of grafted styrene-acrylic resin. In the present invention, the use of polyester resin is most desirable from the perspective of improving low-temperature fixing characteristics.

Although the softening point of the binder resin is conventionally often regulated as a means of improving the low-temperature fixing characteristics of the toner, in the present invention it has been discovered that the glass transition temperature correlates more closely with low-temperature fixing characteristics than does the softening point of the binder resin. Accordingly, the binder resin in the present invention has a glass transition point in the range of 45–65° C., and desirably in the range of 50–60° C., from the perspective of further improving heat-resistant storage characteristics and low-temperature fixing characteristics. The softening point of the binder resin is desirably 120° C. or less from the perspective of color reproduction and glossiness of the full color image.

In the present invention, polyester resin obtained by condensation polymerization of a polyvalent alcohol component and polyvalent carboxylic acid component may be used as the polyester resin.

Examples of useful bivalent alcohol components among the polyvalent alcohol components include bisphenol A alkaline oxides such as polyoxypropylene (2,2)-2,2-bis(4-hydroxyphenyl)propane, polyoxypropylene (3,3)-2,2-bis(4-hydroxyphenyl)propane, polyoxypropylene (6)-2,2-bis(4-hydroxyphenyl)propane, polyoxyethylene (2,0)-2,2-bis(4-hydroxyphenyl)propane, polyoxyethylene (2,2)-2,2-bis(4-hydroxyphenyl)propane and the like, and ethylene glycol, diethylene glycol, triethylene glycol, 1,2-propylene glycol, 1,3-propylene glycol, 1,4-butane diol, neopentyl glycol, 1,4-butene diol, 1,5-pentane diol, 1,6-hexane diol, 1,4-cyclohexane dimethanol, dipropylene glycol, polyethylene glycol, polytetramethylene glycol, bisphenol A, hydrogenated bisphenol A and the like.

Examples of useful trivalent and higher alcohol components include sorbitol, 1,2,3,6-hexanetetrol, 1,4-sorbitane, pentaerythritol, dipentaerythritol, tripentaerythritol, 1,2,4-pentanetriol, 1,2,5-pentanetriol, glycerol, 2-methylpropanetriol, 2-methyl-1,2,4-pentane triol, trimethylol ethane, trimethylol propane, 1,3,5-trihydroxymethylbenzene and the like.

Examples of useful bivalent carboxylic acid component among the polyvalent carboxylic acid components include maleic acid, fumaric acid, citraconic acid, itaconic acid, glutamic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, indodecenylsuccinic acid, n-dodecylsuccinic acid, indododecylsuccinic acid, n-octenylsuccinic acid, isooctenylsuccinic acid, n-octylsuccinic acid, isooctylsuccinic acid, and anhydrous oxides and low-molecular alkyl esters thereof. Examples of useful trivalent and higher carboxylic acid components include 1,2,4-benzenetricarboxylic acid(trimellitic acid), 1,2,5-benzenetrimellitic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, and anhydrous acids and low-molecular alkyl esters thereof.

In the polyester resin comprised of the aforesaid monomer components, it is desirable that the polyester resin is obtained using a main component of bisphenol A alkaline oxide as a polyvalent alcohol component, and a main component having at least one type selected from a group comprising terephthalic acid, fumaric acid, dodecenylsuccinic acid and benzenetricarboxylic acid as a polyvalent carboxylic acid component.

From the perspective of improving low-temperature fixing characteristics, it is desirable to produce a polyester resin using polyoxypropylene(2,2)-2,2-bis(4-hydroxyphenyl) propane (hereinafter referred to as "PO") and polyoxyethylene(2,2)-2,2-bis(4-hydroxyphenyl)propane (hereinafter referred to as "EO") as the polyvalent alcohol component, and using terephthalic acid and fumaric acid as the polyvalent carboxylic acid component. At this time, it is desirable that EO is used in greater quantity than PO, and fumaric acid is used in greater quantity that terephthalic acid. This arrangement is preferred to prevent the glass transition point from being elevated too high while maintaining a desired pulverization index.

When the aforesaid polyester resin is used as a binder resin, the acid value is desirably 3–30 KOHmg/g, and more desirably 3–20 KOHmg/g. Using a polyester resin having such an acid value produces a toner having improved dispersion of charge controlling agent and pigments including carbon black while providing a more adequate charge.

In the present invention, two types of polyester resin having different softening points may be used as the polyester resin so as to improve fixing characteristics and anti-offset characteristics of a toner when heat-roller fixing is used, and to further control glossiness of the image in a full color toner requiring light transmittance. At this time, the acid value of the mixed resins is desirably within the previously mentioned range.

Well-known pigments and dyes used as conventional colorants for full color toner may be used as colorant in the present invention. Examples of useful colorants include carbon black, activated carbon, titanium black, aniline blue, chalcoyl blue, chrome yellow, ultramarine blue, DuPont oil red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. pigment red 184, C.I. pigment yellow 12, C.I. pigment yellow 17, C.I. pigment yellow 93, C.I. pigment yellow 97, C.I. pigment yellow 109, C.I. pigment yellow 110, C.I. pigment yellow 155, C.I. pigment yellow 180, C.I. pigment yellow 185, C.I. solvent yellow 162, C.I. pigment blue 15:1, C.I. pigment blue 15:3 and the like. In black toner, the colorant of various types of carbon black, activated carbon, titanium black and the like may be replaced wholly or in part by a magnetic material. Useful examples of well known magnetic material particles include ferrite, magnetite, iron and the like. It is desirable that within the meaning of obtaining dispersibility during manufacture, the average particle size of the magnetic particles is 1 $\mu$m or less, and more desirably 0.5 $\mu$m or less. When a toner possesses non-magnetic toner qualities and magnetic material is added to prevent airborne dispersion, the amount added should be 0.5–10 parts-by-weight, and desirably 0.5–8 parts-by-weight, and more desirably 1–5 parts-by-weight, relative to 100 parts-by-weight binder resin.

The colorant content may be set in accordance with the maximum amount of adhered toner in image formation and opacifying power of the colorant, but in the present invention, since the chargeability of each toner is largely unchanged even when relatively large amount of colorant is loaded, relative large amount of colorant may be used effectively. For example, when the maximum amount of adhered toner on a recording medium is 4 g/m$^2$, C.I. pigment read 57 is used in a range of 4~8 parts-by-weight, C.I. pigment yellow 180 is used in a range of 6.5–12 parts-by-weight, and C.I. pigment blue 15:3 is used in a range of 5.5–10 parts-by-weight (the standard being 100 parts-by-weight binder resin). Furthermore, the colorants used in magenta, cyan, and yellow toners is desirably produced as a master batch obtained by fusion kneading with the binder resin beforehand and subsequently pulverized; the amount used at that time should be such that the colorant content of the obtained toner is within the previously described range.

Charge controller and separation agent may be included in the toner as desired.

The charge controller used for magenta toner, cyan toner, and yellow toner will be colorless, white, or light color so as to not adversely affect color tone and light transmittance of the color toner; useful examples include zinc of salicylic acid derivative, metal complex of chrome, calix arene compound, organic boron compound, quaternary ammonium salt with fluorine and the like. U.S. Pat. No. 4,206,064, for example, discloses a toner using metal salicylic acid complex; U.S. Pat. No. 5,049,467, for example, discloses a toner using calix arene compound; and U.S. Pat. No. 4,767,688 and U.S. Pat. No. 5,863,692, for example, disclose toners using organic boron compound.

Wax may be used as a separation agent. Well-known waxes in the field of toners used in electrostatic image development may be used. Examples of useful waxes include polyethylene wax, polypropylene wax, carnauba wax, rice wax, sazol wax, montan wax, fischer-tropsch wax, paraffin wax and the like, and from the perspective further improving low-temperature fixing characteristics and improving separation from the fixing roller it is desirable that a low melting point wax is used, and it is particularly desirable that that the melting point of the wax is in a range of 50–90° C. The amount of added separation agent is 0.5–15 parts-by-weight, and desirably 1–10 parts-by-weight, relative to 100 parts-by-weight binder resin.

To produce the toner, first, binder resin, polymer (B), and colorant as well as other additives, e.g., separation agent, charge controller and the like, are mixed using a well known mixing device, and thereafter fusion kneaded in a well known kneading device, then cooled to obtain a kneaded material. Then, the kneaded material is pulverized and classified, and subjected to momentary heating process as desired. In the present invention, the volume-average particle size of the toner particles is ultimately 3–7.5 $\mu$m, and desirably 4–6.5 $\mu$m. When the particle size is too small, the adhesion power between toner particles becomes excessive due to the large toner surface area, and the problem of toner flocculation arises during storage, replenishment, and development. When the toner particle size is too large, a level of required granularity (a fineness of texture) for a full color image cannot be attained. The device used for the momentary heating process may be, for example, a surfusing system (Nippon Pneumatic Mfg. Co., Ltd.).

It is desirable that various types of organic/inorganic microparticles (post-processing agent) are added to facilitate fluidity and cleaning. Examples of useful inorganic particles include various carbon compounds such as silicon carbide, boron carbide, titanium carbide, zirconium carbide, hafnium carbide, vanadium carbide, tantalum carbide, niobium carbide, tungsten carbide, chrome carbide, molybdenum carbide, calcium carbide, diamond carbon black and the like, various nitrides such as boron nitride, titanium nitride, zirconium nitride and the like, various boride compounds such as zirconium boride and the like, various oxide compounds such as titanium oxide, calcium oxide, magnesium oxide, zinc oxide, copper oxide, aluminum oxide, silica, colloidal silica and the like, various titanium oxide compounds such as calcium titanate, magnesium titanate, strontium titanate and the like, various sulfides such as molybdenum disulfide and the like, various fluorides such as magnesium fluoride, carbon fluoride and the like, various metallic soaps such as aluminum stearate, calcium stearate, zinc stearate, magnesium stearate and the like, and various non-magnetic inorganic particles such as talc, bentonite and the like, which may be used individually or in combination.

Organic particles such as styrene, (meth)acrylate, benzoguanamine melamine, teflon, silicone, polyethylene, polypropylene and like particles manufactured by wet polymerization methods such as emulsion polymerization, soap-free emulsion polymerization, non-aqueous dispersion polymerization and the like, or gas phase methods may be used for the purpose of cleaning agent.

From the perspective of heat resistant storage characteristics and environmental stability, it is desirable that inorganic particles, and particularly silica, titanium oxide, alumina, zinc oxide and the like, are subjected to surface processing by well known methods using processing agents such as hydrophobic processing agent such as silane coupling agent, titanate coupling agent, silicon oil, silicon wax and the like, silane coupling agent with fluoride, silicon oil with fluoride, coupling agent having an amino group and quaternary ammonium salt group, modified silicon oil and the like.

In the present invention, the structure of the particles (post-processing agent) added externally to the magenta toner, cyan toner, and yellow toner is approximately identical, and desirably identical. In this case "approximately identical" and "identical" pertaining to particle structure is defined as determining a target of all post-processing agent added at 0.3 parts-by-weight or higher to 100 parts-by-weight of toner in each toner, and commonly adding post-processing agent "approximately identical" or "identical" in type and quantity in each toner. The type of post-processing agent is defined as including a chemical structure expressing the raw material of the particle and an average primary particle size, and in particular the approximate identicalness of the type of post-processing agent is defined as particle raw material represented by identical chemical structure regardless of the presence of surface processing, wherein the average primary particle size of the post-processing agent represented by identical chemical structure in each toner is within a range of ±20% of the respective average value. Furthermore, the approximate identicalness of the quantity of the post-processing agent is defined as the quantity of post-processing agent represented by identical chemical structure added in each toner (i.e., quantity added to 100 parts-by-weight toner) being within a range of ±20% of the average value of the respective average value. Since the structure of the post-processing agent differs for toner of each color and the developing characteristics and transfer characteristics of the toner varies for each color toner, the developing conditions and the like must be designed for toner of each color. In the present invention, although black toner may be designed separately from the magenta toner, cyan toner, and yellow toner to reduce cost, it is desirably designed similarly.

The particles desirable are 0.05–5 parts-by-weight, and more desirably 0.1–3 parts-by-weight, relative to 100 parts-by-weight toner. The particles may be used in combinations of two or more types, in which case the total quantity is within the aforesaid range.

When using a carrier so as to use the aforesaid toner as a two-component developer, well-known conventional carriers may be used as the carrier in the two-component developer. Examples of useful carriers include carriers comprising magnetic particles such as iron, ferrite and the like, resin core carriers wherein the aforesaid magnetic particle is covered by resin, or binder-type carriers wherein a fine powder of magnetic particles is dispersed in binding resin. Among these carriers, silicon resin, copolymer resin (graft resin) of organopolysiloxane and vinyl monomer, and resin coated carrier using polyester resin may be used as a coated resin and are desirable from the perspective of spent toner, and particularly carrier coated with resin obtained by reacting isocyanate with a copolymer resin of organopolysiloxane and vinyl monomer is desirable from the perspective of durability, environmental stability, and spent resistance. It is desirable to use a monomer having an exchange group such as a hydroxyl group or the like having reactivity with isocyanate as the vinyl monomer. Furthermore, it is desirable to use a carrier having a volume-average particle size of 20~100 $\mu$m, and more desirably 20–60 $\mu$m, from the perspective of assuring high image quality and preventing carrier fog.

The full color image forming method is described below.

The full color image forming method of the present invention characteristically uses a developer such as described above, in a well-known full color image forming method, and controls the maximum amount of adhered magenta toner, cyan toner, and yellow toner adhered to a recording medium to a relatively small value.

Specifically, in a full color image forming method wherein a process to form a latent image on an electrostatic latent image carrier (photosensitive body), and develop the latent image with a developer, and a process to transfer the toner image formed on the electrostatic latent image carrier onto a recording medium either through an intermediate transfer body or directly are repeatedly executed for developer of each color, and including the fixing of the toner image transferred onto the recording medium, the maximum amount of magenta toner, cyan toner, and yellow toner adhered on the recording medium is controlled to a value of 5.0 $g/m^2$ or less, and desirably 2.0–5.0 $g/m^2$, and more desirably 3.0–4.8 $g/m^2$. In the present invention, it is possible to provide high quality full color images at high speed and low cost by using the aforesaid specific developer at a specific "maximum amount of toner adhered on the recording medium". When the amount of adhered toner exceeds 5.0 $g/m^2$, fixing at relatively low temperature becomes difficult, and a relatively high fixing temperature and/or relatively long time are required to attain adequate fixing, such that it is not possible to simultaneously accomplish full color image formation at high speed and low cost.

In the present invention, when the aforesaid developer is used at the "maximum amount of adhered toner on a recording medium", the difficulty of setting the conditions for each toner during developing can be reduced by having the "maximum amount of adhered toner on a recording medium" of magenta toner, cyan toner, and yellow toner within a range of ±5% of the respective average value. That is, the difficulty of setting the conditions for each toner during developing is reduced, and it becomes possible to produce a high quality full color image at high speed and low cost.

In the present invention, the maximum amount of adhered toner on a recording medium of magenta toner, cyan toner, and yellow toner is controlled to identical value within the aforesaid range, such that the maximum amount of adhered toner on a recording medium is unchanged for each toner, making it possible to provide high quality full color images at high speed and low cost.

In the present invention, the maximum amount of adhered black toner on a recording medium is desirably controlled identically to the maximum amount of adhered magenta toner, cyan toner, and yellow toner on a recording medium. It is possible to easily provide high quality full color images at high speed and low cost using these controls. For this reason, when using carbon black as a colorant, it is desirable that carbon black is adequately dispersed.

In the present invention, the "maximum amount of adhered toner on a recording medium" is the "maximum amount of toner ultimately adhered on the recording medium", and is one condition set beforehand for each toner in a full color image-forming device.

The "maximum amount of adhered toner on a recording medium" is determined dependent on the "maximum amount of toner adhered to the electrostatic latent image carrier by development" (hereinafter referred to as "maximum adhered amount of toner on the photosensitive body") as well as "the transfer efficiency from the electrostatic latent image carrier to the recording medium (when an intermediate transfer body is not used), or "the transfer efficiency from the electrostatic latent image carrier to an intermediate transfer body and the transfer efficiency from the intermediate transfer body to the recording medium" (when an intermediate transfer body is used). The maximum adhered amount of toner on the photosensitive body is determined by the potential of the image area and the potential of the non-image area on the electrostatic image carrier, the surface potential of the developer carrier, the distance between the electrostatic latent image carrier and the developer carrier, the magnetic force of the carrier, the resistance of the carrier, the amount of developer transported on the developer carrier, the circumferential speed-ratio of the developer carrier and electrostatic latent image carrier and the like.

The formation of a full color image using the aforesaid image forming method is described below. First, the photosensitive body (electrostatic latent image carrier) of a photosensitive drum is uniformly charged by a primary charger, and an image is exposed thereon by a laser beam modulated by magenta image signals of an original document so as to form an electrostatic latent image on the photosensitive drum. Then, the electrostatic latent image is developed by a magenta developing device accommodating developer including magenta toner so as to form a magenta toner image on the photosensitive drum, and thereafter the magenta toner image is transferred by a transfer charger onto a recording medium. On the other hand, after the magenta toner image has been transferred, the photosensitive drum is discharged by a discharge device, and cleaned by a cleaning means. Thereafter, the photosensitive drum is again charged by a primary charger, and a latent image is formed on the photosensitive drum optical exposure by a laser beam modulated by cyan image signals, the latent image is developed by developer including cyan toner, and thereafter the cyan toner image is transferred onto the recording medium which received the magenta toner image, in the same manner as the image forming method of the magenta toner image. Next, yellow toner image formation and black toner image formation are sequentially performed in a similar manner to the magenta toner image forming method, such that color toner images of four colors are transferred onto the recording medium, and the transferred full color image is then fixed via pressure and heat using a fixing roller and the like.

There is no particular problem even if the sequence of forming each color image is changed. Although a structure wherein each color toner image is directly transferred onto a recording medium has been described above, each color toner image may be overlaid in sequential transfer to an intermediate transfer body such as an intermediate transfer belt or the like, and the overlaid images may be batch transferred onto a recording medium.

When implementing the full color image forming method of the present invention, since the chargeability of the developer and sensitivity of the photosensitive body change, and, therefore, the "maximum amount of toner adhere to the photosensitive body" (maximum amount of toner adhered to the recording medium) changes in conjunction with change in the operating environment of the device using this method, it is desirable to employ periodic automatic density control (automatic control of the maximum amount of toner adhered to the photosensitive body) for each toner among the plurality of toners of different color.

Automatic density control corrects the maximum amount of adhered toner on the photosensitive body to a standard value by suitably modifying variable developing conditions such as the potential of the image area and potential of the non-image area on the electrostatic latent image carrier, and the surface potential of the developer carrier based on the amount of toner adhered in a standard image (solid image) formed on the electrostatic latent image carrier under specific developing conditions.

A desirable mode is that the aforesaid automatic density control is accomplished by periodically measuring the surface potential of the electrostatic latent image carrier charged under specific conditions via a surface potential measuring means, recording the measured value via a recording means, comparing the measured value to a previously measured value recorded by the recording means, and executing automatic density control when the amount of change exceeds a specific value, and maintaining the previous developing conditions by not executing automatic density control when the amount of change is less than a specific value. When executing automatic density control, it is necessary to wait several seconds until a single page image is output, however, executing control in accordance with the amount of change in the surface potential of the electrostatic latent image carrier is relatively effective in eliminating small automatic density control, such that the number of times automatic density control is effectively executed is reduced, thereby improving operation efficiency.

Another desirable mode is that when executing automatic density control, a first mode is selected for setting developing condition to form a standard toner image for each toner of a plurality of different color toners in accordance with the amount of change in surface potential of the electrostatic latent image carrier, or a second mode is selected to set developing conditions for forming a standard toner image of a specific color among the plurality of different color toners, and set developing conditions for the other color toners based on the developing conditions of the specific color toner. When a selection is made based on the amount of change in the surface potential of the electrostatic latent image carrier, it is unnecessary to execute automatic density control for toners of all colors, such that the number of executions of the automatic density control is reduced, thereby improving operation efficiency.

In the method of the present invention, the previously mentioned two desirable modes may be combined to further improve operation efficiency, and provide high quality full color images at high speed and low cost over a long time.

Production of Binder Resin (Polyester Resin)

An alcohol component and acid component together with a polymerization initiator (dibutyl tin oxide) were introduced in the ratio shown in Table 1 into a glass four-mouthed flask with mounted thermometer, mixing device, flow-type condenser, and nitrogen inlet tube. The material was mixed and reacted at a temperature of 220° C. in a mantel heater under a nitrogen atmosphere to obtain polyester resins A1 and A2. The obtained polyester resins had the physical properties shown in Table 1. In the table, PO represents polyoxypropylene(2,2)-2,2-bis(4-hydroxyphenyl)propane, EO represents polyoxyethylene(2,2)-2,2-bis(4-hydroxyphenyl)propane, TPA represents terephthalic acid, and FA represents fumaric acid.

Production of Polymer (B)

Resin B1

150 g styrene (99.9% purity) and 150 g toluene were mixed in an autoclave while maintaining a temperature of 5° C., and 1.5 g $BF_3$-phenolcomplex was slowly titrated over approximately 10 min. Thereafter, the material was mixed continuously for 3 hr. Next, 50 ml of 5% sodium hydroxide solution was added and mixed vigorously for 30 min, and after the catalyst decomposed, the water layer was separated, and the polymerized oil was washed until neutralized, and thereafter the unreacted oil and solvent. toluene were removed, and 120 g polystyrene was obtained as residue. This polymer was designated polymer B1, and its physical properties are listed in Table 2.

Polymer B2

150 g α-methyl styrene (99.8% purity) and 150 g toluene were mixed in an autoclave while maintaining a temperature of 5° C., and 1.5 g $BF_3$-phenol complex was slowly titrated over approximately 10 min. Thereafter, the material was mixed continuously for 3 hr. Next, 50 ml of 5% sodium hydroxide solution was added and mixed vigorously for 30 min, and after the catalyst decomposed, the water layer was separated, and the polymerized oil was washed until neutralized, and thereafter the unreacted oil and solvent toluene were removed, and 120 g poly-α-methylstyrene was obtained as residue. This polymer was designated polymer B2, and its physical properties are listed in Table 2.

Polymer B3

250 g α-methyl styrene (99.8% purity), 250 g isopropenyltoluene, and 500 g toluene were introduced into a three-mouthed flask, and mixed while boron trifluoride phenol complex was slowly added, and the material was then cooled under dry ice and acetone solvent and reacted for 3 hr at 20° C. Next, alkali was added to inactivate and remove the catalyst, and concentrated to remove the solvent and unreacted monomer, and α-methylstyrene-isopropenyltoluene copolymer was obtained as a residue. This polymer was designated Polymer B3, and its physical properties are listed in Table 2.

Polymer B4

200 g isopropenyltoluene (98% purity), 200 g α-methylstyrene (98% purity), 120 g C5 petroleum fraction (isoprene) obtained from thermal decomposition of petroleum naphtha, and 500 g toluene were introduced into a three-mouthed flask, and mixed while boron trifluoride phenol complex was slowly added, and the material was then cooled under dry ice and acetone solvent and reacted for 3 hr at 20° C. Next, NaOH aqueous solution was added and vigorously mixed decompose the catalyst, and thereafter separated in a bath to obtain an oil-like polymer. Finally, the oil-like polymer was washed until neutralized, and thereafter

TABLE 1

| Polyester | Alcohol component | | Acid component | | | | Tg | Tm | Acid value | Hydroxyl value | Pulverization |
|---|---|---|---|---|---|---|---|---|---|---|---|
| resin | PO | EO | FA | TPA | Mn | Mw/Mn | (° C.) | (° C.) | (KOH mg/g) | (KOH mg/g) | index |
| A1 | 1.0 | 10.0 | 7.0 | 2.0 | 3500 | 3.6 | 55.4 | 98.0 | 4.8 | 29.1 | 2.2 |
| A2 | 10.0 | 1.0 | — | 9.0 | 3900 | 3.8 | 64.5 | 100.2 | 3.8 | 27.4 | 1.8 |

the unreacted oil and solvent were removed by heating under a vacuum, and a white mass of α-methylstyrene-isopropenyltoluene-isoprene copolymer was obtained as a residue. This polymer was designated polymer B4, and its physical properties are listed in Table 2.

Polymer B5

Polystyrene was obtained by the same method as the resin B1 with the exception that the reaction period was 2 hr. This polymer was designated polymer B5, and its physical properties are listed in Table 2.

Polymer B6

Poly-α-methyl styrene was obtained by the same method as the resin B2 with the exception that the reaction period was 4.5 hr. This polymer was designated polymer B6, and its physical properties are listed in Table 2.

TABLE 2

| | Polymer (B) | Mw | Mn | Mw/Mn | Tg (° C.) | Pulverization index |
|---|---|---|---|---|---|---|
| B1 | Polystyrene | 1500 | 1000 | 1.5 | 62 | 0.3 |
| B2 | Poly-α-methylstyrene | 2800 | 1500 | 1.9 | 75 | 0.5 |
| B3 | α-methylstyrene-isopropenyltoluene copolymer | 2400 | 1500 | 1.6 | 72 | 0.5 |
| B4 | α-methylstyrene-isopropenyltoluene -isoprene copolymer | 1900 | 1100 | 1.7 | 65 | 0.3 |
| B5 | Polystyrene | 900 | 650 | 1.4 | 40 | 0.2 |
| B6 | Poly-α-methylstyrene | 3100 | 1700 | 1.8 | 88 | 0.7 |

Production of Pigment Master Batch

The pigment used in the production of the full color toner may be used as a pigment master batch obtained by the method described below. The binder resin and pigments used in each example and reference example were a) loaded in a pressure kneader at a weight ratio of 7:3 (resin: pigment), and kneaded for 1 hr at 120° C. After cooling, the material was coarsely pulverized in a hammer mill to obtain a pigment master batch having a pigment content of 30 parts-by-weight. C.I. pigment yellow 180 (Hoechst, Co.) C.I. pigment blue 15-3 (Dainippon Ink and Chemicals, Inc.) and C.I. pigment red 57-1 (Dainippon Ink and Chemicals, Inc.) were used as pigments.

Toner M1

The polyester resin A and pigment master batch were mixed in proportions of 100 parts-by-weight polyester resin A and 5 parts-by-weight C.I. pigment 57-1, and to this mixture was added 10 parts-by-weight resin B1, and after the total mixture was mixed in a HENSCHEL mixer, it was fusion kneaded in an extruder. After the obtained kneaded material was cooled, it was coarsely pulverized, then finely pulverized to obtain pulverized material having a volume-average particle size of 5.5 μm. Thereafter, the pulverized material was classified, to obtain toner particles having a volume-average particle size of 6 μm. To 100 parts-by-weight of the toner particles was added 0.9 parts-by-weight hydrophobic silica (H2000; Hoechst), 0.9 parts-by-weight hydrophobic titanium oxide (particle size: 50 nm), and 2.0 parts-by-weight strontium titanate (particle size: 350 nm; BET specific surface area: 9 $m^2/g$), and this mixture was mixed in a HENSCHEL mixer to obtain magenta toner M1.

Toners Y1 and C1

Toners Y1 and C1 were obtained by the same production process as the toner M1 with the exception that the pigment master batch was changed, and polyester resin A1 and pigment master batch were used in proportions of 100 parts-by-weight polyester resin A1 and 8.5 parts-by-weight C.I. pigment yellow 180, and 100 ports-by-weight polyester resin A1 and 7 parts-by-weight C.I. pigment blue 15-3.

Toner K1

Toner K1 was obtained by the same production process as the toner M1 with the exception that the pigment master batch was changed to carbon black (Mogul L; Cabot Corp.; pH 2.5, average primary particle size 24 nm), and polyester resin A1 and carbon black were mixed in proportions of 100 parts-by-weight polyester resin A1 and 8 parts-by-weight carbon black.

Toners M2–M12

Toners M2–M12 were obtained by the same production process as the toner M1 with the exception that the binder resin, polymer (B), and pigment master batches shown in Tables 3–6 were used as toner components.

Toners Y2–Y12

Toners Y2–Y12 were obtained by the same production process as the toner Y1 with the exception that the binder resins shown, polymer (B), and pigment master batches shown in Tables 3–6 were used as toner components.

Toners C2–C12

Toners C2–C12 were obtained by the same production process as the toner C1 with the exception that the binder resins shown, polymer (B), and pigment master batches shown in Tables 3–6 were used as toner components.

Toners K2–K12

Toners K2–K12 were obtained by the same production process as the toner K1 with the exception that the binder resins shown, polymer (B), and carbon black shown in Tables 3–6 were used as toner components.

EXAMPLES AND COMPARATIVE EXAMPLES

The toners shown in Tables 3–6 were used in combination in the following examples and reference examples, and evaluated by the criteria described below.

Production Property

When specimens (toner composition; i.e., the material passing through a 2 mm mesh in a feather mill after kneading and cooling) were pulverized at processing amount F (5 kg/h) and KTM 12000 (rpm) using a mechanical pulverizer (model KTM-0; Kawasaki Heavy Industries, Ltd.), a load force value WO was recorded when specimen did not pass through, and a load force W1 was recorded when specimen passed through. Thereafter, the volume-average particle size D (μm) of the KTM pulverized material was measured using a COULTER Multisizer II (Beckman Coulter, Inc.).

The pulverization index was calculated, and ranked and evaluated based on the equation below.

Pulverization index (H)=(D×(W1−W0))/F

⊙: 1.0≦H<1.5

○: 0.5≦H<1.0, or 1.5≦H<2.0 x: H<0.5 (too soft), or 2.0≦H (too hard)

Heat-resistant Storage Property

After 10 g of toner was stored 24 hr at a temperature of 50° C., the state of toner cohesion was visually ascertained. Each toner was evaluated and the worst results listed.

⊙: No cohesion observed at all

○: Cohesion observed, but broke loose with weak impact x: Cohesion observed, but not easily broken loose

Charge Characteristics

The amount of toner charge was measured using a field separation method. The average value was determined from the charge of the magenta toner, cyan toner, yellow toner, and black toner. The difference between the charge of each toner and the average value was determined, and the percentage (X; (%)) of the difference relative to the average value was determined. The percentage was evaluated according to the rankings listed below. Each toner was evaluated, and the worst results listed. The carrier was an acrylic-modified silicon-coated ferrite carrier.

⊙: −5≦X≦5 (%)

O: −10≦X<−5 (%), or S<≦10 (%)

x: X<−10 (%), or 10<X (%)

In the following evaluations, a two-component developer obtained by mixing toner and acrylic-modified silicon-coated ferrite carrier was used so as to have a ratio of 5 percent-by-weight toner.

Graininess

Magenta, cyan, yellow, and black two-component developers were loaded in a digital full color copier (model CF910; Minolta Co., Ltd.) with the maximum amount of adhered toner set at the values shown in Tables 3–6, and The Society of Electrophotographic of Japan Chart 1995 No. 5-1 was copied.

O: Better than current product graininess x: Poorer than current product graininess

Low-temperature Fixing Property

Magenta, cyan, yellow, and black two-component developers were loaded in a digital full color copier (model CF910; Minolta Co., Ltd.) with the maximum amount of adhered toner set at the values shown in Tables 3–6, and a three-color overlay image (magenta toner, cyan toner, yellow toner) measuring 1.5×1.5 cm was printed while changing the fixing temperature in increments of 2° C. within a range of 120–170° C. The image was folded in half from the center, and the image peeling characteristics were visually evaluated. The temperature between the fixing temperature at which the image peeled to the edge of the fold and the fixing temperature at which the image peeled only at the fold was designated lower limit fixing temperature.

⊙: Lower limit fixing temperature less than 145° C.

○: Lower limit fixing temperature greater than 145° C., but less than 155° C.

Δ: Lower limit fixing temperature greater than 155° C., but less than 165° C. (no problem for practical use)

x: Lower limit fixing greater than 165° C. (inadequate for practical use)

TABLE 3

| | Toner | | | Toner preparation condition | | | Maximum | Evalaution | | | | |
|---|---|---|---|---|---|---|---|---|---|---|---|---|
| | | Average | | Polymer (B) | | Colorant | adhering | | | | | Low-temp- |
| | Kind | particle size (μm) | Binder resin | Kind | Amount* (part by weight) | Amount** (part by weight) | amount of toner (g/m²) | Product-ion Property | Heat Resist-ance | Grain-iness | Charge Property | erature Fixing Property |
| Ex. 1 | M1 | 6 | A1 | B1 | 10 | 5 | 4.5 | ⊙ | ○ | ○ | ⊙ | ⊙ |
| | Y1 | 6 | A1 | B1 | 10 | 8.5 | | | | | | |
| | C1 | 6 | A1 | B1 | 10 | 7 | | | | | | |
| | K1 | 6 | A1 | B1 | 10 | 8 | | | | | | |
| Ex. 2 | M2 | 6 | A1 | B2 | 10 | 5 | 4.5 | ⊙ | ⊙ | ○ | ⊙ | ○ |
| | Y2 | 6 | A1 | B2 | 10 | 8.5 | | | | | | |
| | C2 | 6 | A1 | B2 | 10 | 7 | | | | | | |
| | K2 | 6 | A1 | B2 | 10 | 8 | | | | | | |
| Ex. 3 | M3 | 6 | A1 | B3 | 10 | 5 | 4.5 | ⊙ | ⊙ | ○ | ○ | ○ |
| | Y3 | 6 | A1 | B3 | 10 | 8.5 | | | | | | |
| | C3 | 6 | A1 | B3 | 10 | 7 | | | | | | |
| | K3 | 6 | A1 | B3 | 10 | 8 | | | | | | |

"*" shows amount of polymer (B) relative to 100 parts by weight of binder resin.

"**" shows amount of colorant relative to 100 parts by weight of binder resin.

TABLE 4

| | Toner | | | Toner preparation condition | | | Maximum | Evalaution | | | | |
|---|---|---|---|---|---|---|---|---|---|---|---|---|
| | | Average | | Polymer (B) | | Colorant | adhering | | | | | Low-temp- |
| | Kind | particle size (μm) | Binder resin | Kind | Amount* (part by weight) | Amount** (part by weight) | amount of toner (g/m²) | Product-ion Property | Heat Resist-ance | Grain-iness | Charge Property | erature Fixing Property |
| Ex. 4 | M4 | 6 | A1 | B4 | 10 | 5 | 4.5 | ◎ | ○ | ○ | ○ | ◎ |
| | Y4 | 6 | A1 | B4 | 10 | 8.5 | | | | | | |
| | C4 | 6 | A1 | B4 | 10 | 7 | | | | | | |
| | K4 | 6 | A1 | B4 | 10 | 8 | | | | | | |
| Ex. 5 | M5 | 6 | A1 | B1 | 5 | 5 | 4.5 | ○ | ○ | ○ | ○ | ◎ |
| | Y5 | 6 | A1 | B1 | 5 | 8.5 | | | | | | |
| | C5 | 6 | A1 | B1 | 5 | 7 | | | | | | |
| | K5 | 6 | A1 | B1 | 5 | 8 | | | | | | |
| Ex. 6 | M6 | 5 | A1 | B1 | 10 | 6.5 | 3.5 | ◎ | ○ | ○ | ○ | ◎ |
| | Y6 | 5 | A1 | B1 | 10 | 11 | | | | | | |
| | C6 | 5 | A1 | B1 | 10 | 9 | | | | | | |
| | K6 | 5 | A1 | B1 | 10 | 8 | | | | | | |

"*" shows amount of polymer (B) relative to 100 parts by weight of binder resin.
"**" shows amount of colorant relative to 100 parts by weight of binder resin.

TABLE 5

| | Toner | | | Toner preparation condition | | | Maximum | Evalaution | | | | |
|---|---|---|---|---|---|---|---|---|---|---|---|---|
| | | Average | | Polymer (B) | | Colorant | adhering | | | | | Low- |
| | Kind | particle size (μm) | Binder resin | Kind | Amount* (part by weight) | Amount** (part by weight) | amount of toner (g/m²) | Production Property | Heat Resistance | Graininess | Charge Property | temperature Fixing Property |
| Ex. 7 | M7 | 6 | A2 | B1 | 10 | 5 | 4.5 | ◎ | ○ | ○ | ◎ | Δ |
| | Y7 | 6 | A2 | B1 | 10 | 8.5 | | | | | | |
| | C7 | 6 | A2 | B1 | 10 | 7 | | | | | | |
| | K7 | 6 | A2 | B1 | 10 | 8 | | | | | | |
| Com. ex. 1 | M8 | 6 | A1 | — | 0 | 5 | 4.5 | × | × | ○ | × | ○ |
| | Y8 | 6 | A1 | — | 0 | 8.5 | | | | | | |
| | C8 | 6 | A1 | — | 0 | 7 | | | | | | |
| | K8 | 6 | A1 | — | 0 | 8 | | | | | | |
| Com. ex. 2 | M9 | 6 | A1 | B1 | 25 | 5 | 4.5 | × | ○ | ○ | ◎ | ○ |
| | Y9 | 6 | A1 | B1 | 25 | 8.5 | | | | | | |
| | C9 | 6 | A1 | B1 | 25 | 7 | | | | | | |
| | K9 | 6 | A1 | B1 | 25 | 8 | | | | | | |

"*" shows amount of polymer (B) relative to 100 parts by weight of binder resin.
"**" shows amount of colorant relative to 100 parts by weight of binder resin.

TABLE 6

| | Toner | | | Toner preparation condition | | | Maximum | Evalaution | | | | |
|---|---|---|---|---|---|---|---|---|---|---|---|---|
| | | Average | | Polymer (B) | | Colorant | adhering | | | | | Low- |
| | Kind | particle size (μm) | Binder resin | Kind | Amount* (part by weight) | Amount** (part by weight) | amount of toner (g/m²) | Production Property | Heat Resistance | Graininess | Charge Property | temperature Fixing Property |
| Com. ex. 3 | M10 | 8 | A1 | B1 | 10 | 3.5 | 7 | ◎ | ○ | × | ◎ | Δ |
| | Y10 | 8 | A1 | B1 | 10 | 6 | | | | | | |
| | C10 | 8 | A1 | B1 | 10 | 5.3 | | | | | | |
| | K10 | 8 | A1 | B1 | 10 | 8 | | | | | | |
| Com. ex. 4 | M11 | 6 | A1 | B5 | 10 | 5 | 4.6 | ◎ | × | ○ | × | ◎ |
| | Y11 | 6 | A1 | B5 | 10 | 8.5 | | | | | | |
| | C11 | 6 | A1 | B5 | 10 | 7 | | | | | | |
| | K11 | 6 | A1 | B5 | 10 | 8 | | | | | | |
| Com. ex. 5 | M12 | 6 | A1 | B6 | 10 | 5 | 4.5 | ○ | ◎ | ○ | × | Δ |
| | Y12 | 6 | A1 | B6 | 10 | 8.5 | | | | | | |
| | C12 | 6 | A1 | B6 | 10 | 7 | | | | | | |
| | K12 | 6 | A1 | B6 | 10 | 8 | | | | | | |

"*" shows amount of polymer (B) relative to 100 parts by weight of binder resin.
"**" shows amount of colorant relative to 100 parts by weight of binder resin.

Production of Acrylic-modified Silicon-coated Ferrite Carrier 100 parts-by-weight methylethyl ketone was loaded in a 500 ml flask provided with a mixing device, condenser, thermometer, nitrogen inlet tube, and titration device. A solvent obtained by dissolving 86.7 parts-by-weight methylmethacrylate, 5.1 parts-by-weight 2-hydroxyethylmethacrylate, 58.2 parts-by-weight3-methacryloxypropyltris(trimethylsiloxane) silane, and 1 part-by-weight 1,1'-azobis(cyclohexane-1-carbonitrile in 100 parts-by-weight methylethyl ketone was titrated over a 2 hr period into a reaction vessel under a nitrogen atmosphere at 80° C., and heated for five hr. The obtained resin was diluted with methylethyl ketone after adjusting isophorone diisocyanate/trimethylolpropane adduct (IPDI/TMP; NCO%=6.1%) to an OH/NCO molar ratio of 1/1, to produce a coated resin solution having a solid ratio of 8 percent-by-weight.

Ferrite F-800 (volume-average particle size: 50 μm; Powdertech Co., Ltd.) was used as a core material. This core material was coated with the aforesaid resin solution to attain a covering resin amount of 1.5 percent-by-weight using a spiller coater (Okada Seiko Co., Ltd.), then dried.

The obtained carrier was calcined for 1 hr at 160° C. in an oven with internal air circulation. After cooling, the bulk ferrite powder was cracked using a sieve shaker mounted with a screen mesh of 75 μm and 106 μm to obtain an acrylic-modified silicon coated ferrite carrier.

Other Measurement Methods

Resin Softening Point Tm Measuring Method

When a 1 $cm^3$ specimen was fusion extruded under conditions of dice pores (1 mm diameter; 1 mm length), 30 $kg/cm^3$ pressure, and temperature elevation speed of 3° C. /min using a flow tester (CFT-500; Shimadzu Corp.), the temperature equivalent to ½ the height from the flow start point to the flow end point was designated the softening point.

The acid value is a value calculated from the amount of consumed N/10 sodium hydroxide/alcohol solution when previously standardized N/10 sodium hydroxide/alcohol solution is titrated using a 10 mg specimen dissolved in 50 ml toluene, and 0.1% bromothymol blue and phenol red mixture indicator.

The toner particle size was measured using a COULTER Multisizer II.

The average particle size of the inorganic particles was determined by measuring the diameter of 100 particles using a transmission electron microscope (model JEM-1000; JEOL Datum Ltd.).

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A method for forming a full color image on a recording medium which comprises forming a latent image and developing the latent image with a developer comprising magenta toner, cyan toner, yellow toner and black toner, wherein a maximum adhering amount of the magenta toner, the cyan toner and the yellow toner on the recording medium is respectively 5.0 $g/m^2$ or less, the magenta toner having a volume-average particle size of 3–7.5 μm, and comprising a magenta colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin;

the cyan toner having a volume-average particle size of 3–7.5 μm, and comprising a cyan colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin;

the yellow toner having a volume-average particle size of 3–7.5 μm, and comprising a yellow colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin; and the black toner having a volume-average particle size of 3–7.5 μm; wherein the polymer in each toner has different pulverization characteristics than the binder resin, and the polymer in each toner is exposed on a surface of the toner particles.

2. The full color image forming method of claim 1, wherein the maximum adhering amount of the magenta toner, the cyan toner and the yellow toner on the recording medium is respectively 3.0–5.0 $g/m^2$.

3. The full color image forming method of claim 1, wherein the maximum adhering amount of the magenta toner, the cyan toner and the yellow toner on the recording medium is respectively 3.0–4.8 $g/m^2$.

4. The full color image forming method of claim 1, wherein the maximum adhering amount of the magenta toner, the maximum adhering amount of the cyan toner and the maximum adhering amount of the yellow toner are within a range of ±5% of an average value of the maximum adhering amount of each toner.

5. The full color image forming method of claim 1, wherein the polymer is a homopolymer or a copolymer of an aromatic monomer and/or an aliphatic monomer.

6. The full color image forming method of claim 1, wherein the binder resin has a glass transition point of 50–60° C.

7. The full color image forming method of claim 1, wherein the magenta toner, the cyan toner, the yellow toner and the black toner respectively includes external additives, the chemical structure, average primary particle size and amount of the external additives of the magenta toner, cyan toner and yellow toner being approximately identical.

8. The full color image forming method of claim 1, wherein a maximum adhering amount of the black toner on the recording medium is 5.0 $g/m^2$ or less.

9. The full color image forming method of claim 8, wherein the black toner comprises a black colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin.

10. The full color image forming method of claim 8, wherein the maximum adhering amount of the black toner on the recording medium is 2.0–5.0 $g/m^2$.

11. The full color image forming method of claim 8, wherein the maximum adhering amount of the black toner on the recording medium is 3.04.8 g/m$^2$.

12. A full color image forming method comprising the steps of forming a latent image on an electrostatic latent image-bearing member, developing the latent image with a developer, transferring the image formed on the electrostatic latent image-bearing member onto a recording medium optionally through an intermediate transfer, and fixing the toner image on the recording medium;

wherein the developer comprises a magenta developer containing magenta toner, cyan developer containing cyan toner, yellow developer containing yellow toner, and black developer containing black toner;

each toner having a volume-average particle size of 3–7.5 μm, and comprising a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin; and the maximum adhering amount of the magenta toner, the cyan toner, and the yellow toner on the recording medium being respectively 5.0 g/m$^2$ or less;

wherein the polymer in each toner has different pulverization characteristics than the binder resin, and the polymer in each toner is exposed on a surface of the toner particles.

13. The full color image forming method of claim 12, wherein the maximum adhering amount of the magenta toner, the cyan toner and the yellow toner on the recording medium is respectively 2.0–5.0 g/m$^2$.

14. The full color image forming method of claim 12, wherein the maximum adhering amount of the magenta toner, the cyan toner and the yellow toner on the recording medium is respectively 3.04.8 g/m$^2$.

15. The full color image forming method of claim 12, wherein the maximum adhering amount of the magenta toner, the maximum adhering amount of the cyan toner and the maximum adhering amount of the yellow toner are within a range of ±5% of an average value of the maximum adhering amount of each toner.

16. The full color image forming method of claim 12, wherein the polymer is a homopolymer or a copolymer of an aromatic monomer and/or an aliphatic monomer.

17. The full color image forming method of claim 12, wherein the binder resin has a glass transition point of 50–60° C.

18. The full color image forming method of claim 12, wherein the magenta toner, the cyan toner, the yellow toner and the black toner respectively includes external additives, the chemical structure, average primary particle size and amount of the external additives of the magenta toner, cyan toner and yellow toner being approximately identical.

19. The full color image forming method of claim 12, wherein a maximum adhering amount of the black toner on the recording medium is 2.0–5.0 g/m$^2$.

20. The full color image forming method of claim 19, wherein the maximum adhering amount of the black toner on the recording medium is 3.0–4.8 g/m$^2$.

21. A method for forming a full color image on a recording medium which comprises forming a latent image and developing the latent image with a developer comprising magenta toner, cyan toner, yellow toner and black toner, wherein a maximum adhering amount of the magenta toner, the cyan toner and the yellow toner on the recording medium is respectively, 2.0–5.0 g/m$^2$, the magenta toner having a volume-average particle size of 3–7.5 μm, and comprising a magenta colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin;

the cyan toner having a volume-average particle size of 3–7.5 μm, and comprising a cyan colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin;

the yellow toner having a volume-average particle size of 3–7.5 μm, and comprising a yellow colorant, a binder resin and a polymer which has a weight-average molecular weight of 1000 to 3000 and a ratio of weight-average molecular weight/number-average molecular weight of 2.0 or less, an amount of the polymer being 1 to 20 parts-by-weight relative to 100 parts-by-weight of the binder resin; and the black toner having a volume-average particle size of 3–7.5 μm;

wherein the polymer in each toner is incompatible with the binder resin, and the polymer in each toner is exposed on a surface of the toner particles.

22. A full color image forming method comprising the steps of forming a latent image on electrostatic latent image-bearing member, developing the latent image with toner, a process of transferring the image formed on the electrostatic latent image-bearing member onto a recording medium optionally through an intermediate transfer, and fixing the toner image on the recording medium;

wherein the toner comprises magenta toner, cyan toner, yellow toner, and black toner;

each toner having a volume-average particle size of 3–7.5 μm, and comprising a binder resin and a polymer which has a weight-average molecular weight of 1000 to 3000, an amount of the polymer being 1 to 20 parts-by-weight relative to 100 parts-by-weight of the binder resin;

the maximum adhering amount of the magenta toner, the cyan toner, and the yellow toner on the recording medium being respectively 5.0 g/m$^2$ or less; and the polymer in each toner is incompatible with the binder resin, and the polymer in each toner is exposed on a surface of the toner particles.

23. The full color image forming method of claim 22, wherein the polymer has a ratio of weight-average molecular weight/number-average molecular weight of 1.9 or less.

* * * * *